US008545063B2

(12) United States Patent
Dupuy et al.

(10) Patent No.: US 8,545,063 B2
(45) Date of Patent: Oct. 1, 2013

(54) LIGHT FIXTURE FOR MOUNTING TO A CEILING

(75) Inventors: Benoit Dupuy, Saint-Jean-Chrysostome (CA); Pascal Lecluze, Saint-Jean-Chrysostome (CA); Jayson Auger, Lévis (CA)

(73) Assignee: Eclairage Contraste M.L. Inc., Quebec (CA)

( * ) Notice: Subject to any disclaimer, the term of this patent is extended or adjusted under 35 U.S.C. 154(b) by 351 days.

(21) Appl. No.: 12/921,093

(22) PCT Filed: Mar. 3, 2009

(86) PCT No.: PCT/CA2009/000274

§ 371 (c)(1),
(2), (4) Date: Jan. 19, 2011

(87) PCT Pub. No.: WO2009/109049

PCT Pub. Date: Sep. 11, 2009

(65) Prior Publication Data

US 2011/0110106 A1 May 12, 2011

Related U.S. Application Data

(60) Provisional application No. 61/034,213, filed on Mar. 6, 2008.

(51) Int. Cl.
*F21V 15/00* (2006.01)

(52) U.S. Cl.
USPC ..... 362/368; 362/365; 362/404

(58) Field of Classification Search
USPC ..... 362/365, 404, 145
See application file for complete search history.

(56) References Cited

U.S. PATENT DOCUMENTS

| | | | |
|---|---|---|---|
| 2,063,923 | A | 12/1936 | Gries |
| 2,744,716 | A | 5/1956 | Zingone |
| 2,965,348 | A | 12/1960 | Gerstel et al. |
| 3,620,401 | A | 11/1971 | Lund |
| 4,250,540 | A | 2/1981 | Kristofek |
| 4,293,895 | A | 10/1981 | Kristofeck |

(Continued)

FOREIGN PATENT DOCUMENTS

| | | |
|---|---|---|
| CA | 2355006 | 7/2004 |
| CA | 2551740 | 8/2007 |

OTHER PUBLICATIONS

International Search Report and Written Opinion issued Jun. 23, 2009 for PCT Application No. PCT/CA2009/000274.

(Continued)

*Primary Examiner* — Anabel Ton
(74) *Attorney, Agent, or Firm* — Meyertons, Hood, Kivlin, Kowert & Goetzel, P.C.; Eric B. Meyertons

(57) ABSTRACT

There is provided a light fixture for mounting to a ceiling, wall or the like, which comprises a pot having a peripheral edge abutting the area adjacent a hole made in the ceiling or wall. A hook and a bolt cooperate to secure the pot to the ceiling or wall. Rotating the bolt causes the hook to move into an abutting engagement with the rear surface of the ceiling, the latter thus being contacted, on the outside, by the peripheral edge of the pot and, on the inside, by that portion of the hook engaging the rear surface of the ceiling.

8 Claims, 6 Drawing Sheets

(56) References Cited

U.S. PATENT DOCUMENTS

| | | | | |
|---|---|---|---|---|
| 4,431,151 | A | 2/1984 | Schonasky | |
| 4,673,149 | A | 6/1987 | Grote et al. | |
| 4,733,339 | A | 3/1988 | Kelsall | |
| 4,739,460 | A | 4/1988 | Kelsall | |
| 5,068,772 | A | 11/1991 | Shapiro et al. | |
| 5,077,650 | A | 12/1991 | Cestari | |
| 5,264,994 | A | 11/1993 | Choi | |
| 5,314,148 | A | 5/1994 | Jones | |
| 5,377,088 | A | 12/1994 | Lecluze | |
| 5,609,414 | A | 3/1997 | Caluori | |
| 5,941,625 | A | 8/1999 | Morand | |
| 6,554,458 | B1 | 4/2003 | Benghozi | |
| 6,565,230 | B2 | 5/2003 | Ashley | |
| 6,588,922 | B1 | 7/2003 | DeCicco | |
| 6,827,471 | B1 | 12/2004 | Benghozi | |
| 7,331,555 | B2 | 2/2008 | St-Pierre | |
| 7,549,780 | B2 * | 6/2009 | Caluori | 362/404 |
| 2007/0217207 | A1 | 9/2007 | Caluori | |

OTHER PUBLICATIONS

Supplementary European Search Report issued Mar. 3, 2011 in European Patent Application No. 09717605.

* cited by examiner

LIGHT FIXTURE FOR MOUNTING TO A CEILING

CROSS-REFERENCE TO RELATED APPLICATIONS

This application is a National Entry Application of PCT application No. PCT/CA2009/000274 filed on Mar. 3, 2009 and published in English under PCT Article 21(2) as PCT Publication No. WO 2009/109049, which claims the benefit of U.S. provisional application Ser. No. 61/034,213, filed on Mar. 6, 2008.

FIELD OF THE INVENTION

The present invention relates to light fixture for mounting to a ceiling, a wall or the like.

BACKGROUND OF THE INVENTION

There are various fastening devices to mount a light fixture, in the form of a pot, to a ceiling or the like. With those using a spring arrangement, the fixing is accomplished inside the hole. Other systems require a metallic plate inside the ceiling, which results in an electrician to work inside the ceiling to carry out the mounting operation. Other devices require the provision of a lath to which the pot is fixed.

It has been found that, in most cases, to secure the pot to the ceiling often causes some damage to the material of the ceiling or delays are often encountered due to the need to handle the different pieces of the light fixture.

Therefore, there is a need in the art for a mounting system for recessed lighting fixtures.

DESCRIPTION OF EMBODIMENTS OF THE INVENTION

Figure 1:
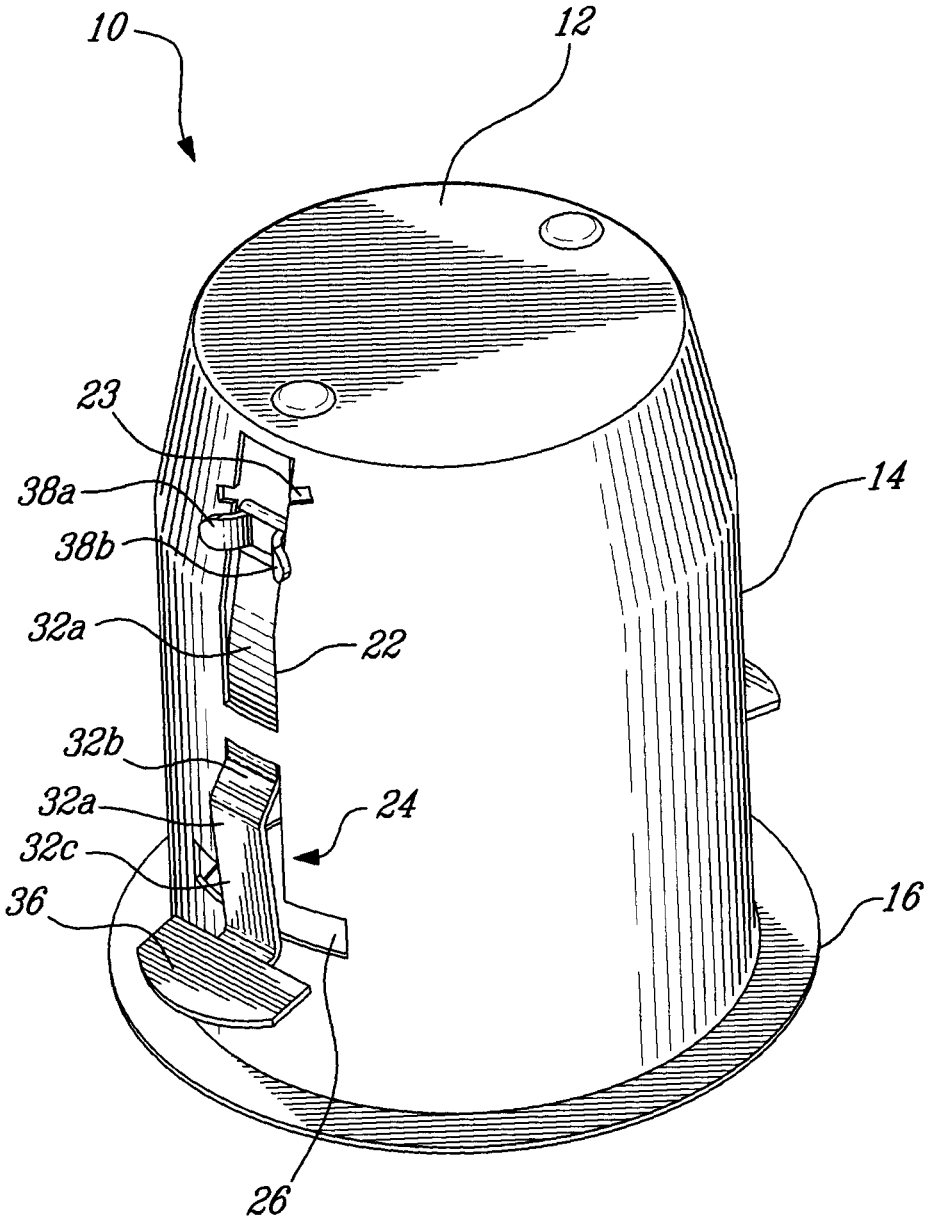
FIG. 1 is a perspective view of a pot of a light fixture according to an embodiment of the present invention.

Referring to FIG. 1, there is shown a pot 10 having a bottom wall 12 and a sidewall 14.

Figure 4:
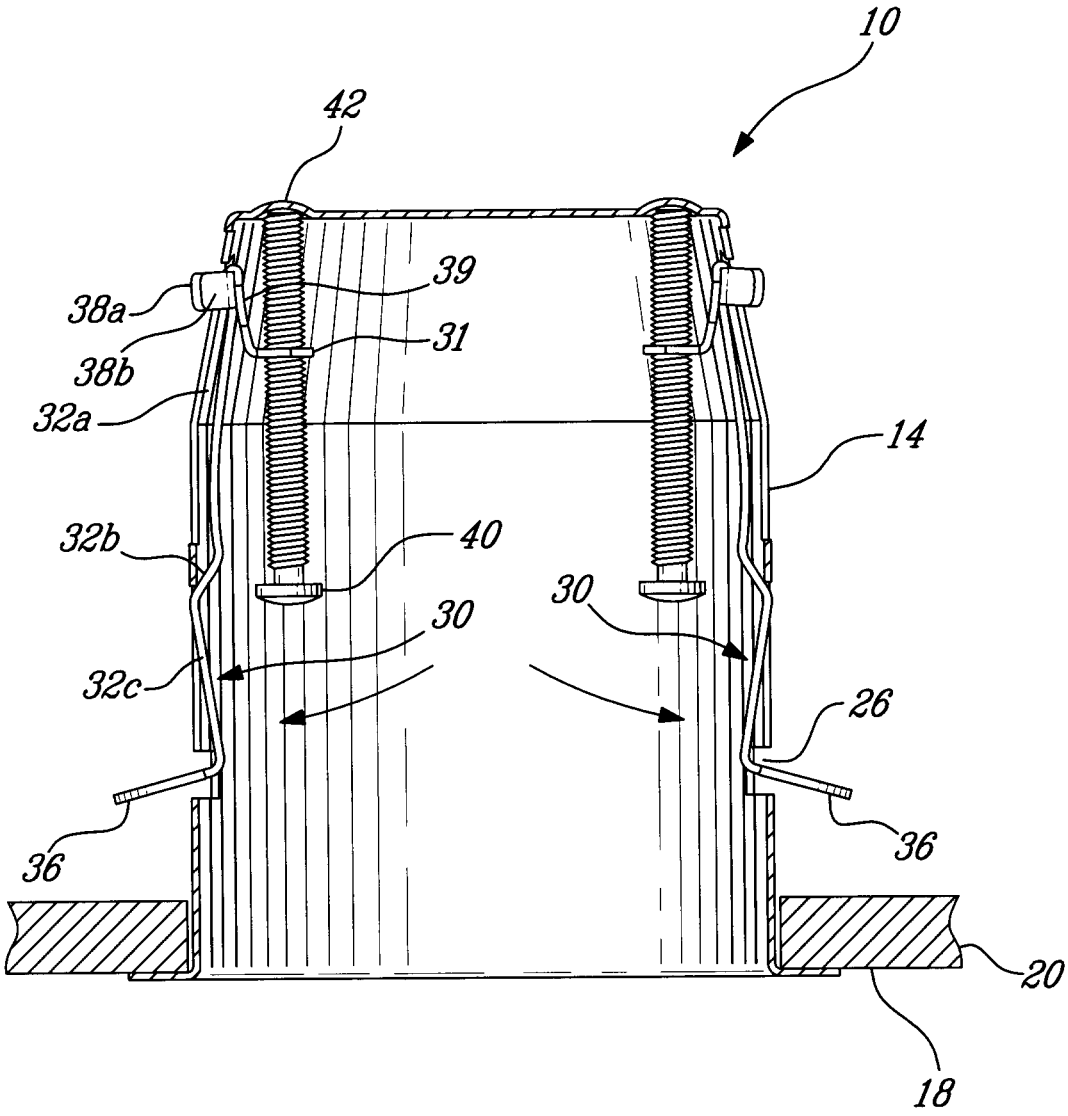

The sidewall 14 has a peripheral outer flange 16, which is adapted to bear against a surface 18 of a ceiling or a wall 20, as best seen in FIG. 4. The sidewall 14 displays at least one aperture comprising a first slot 24 and a second slot 22 aligned with respect to one another, as illustrated in FIG. 1 which shows vertically aligned first slot 24 and a second slot 22. The first slot 24, of a general shape of an upside down T, has an enlarged section 26. The second slot 22 may comprise a transverse channel 23 for ease of insertion of a hook, as described hereinbelow.

Figure 2:
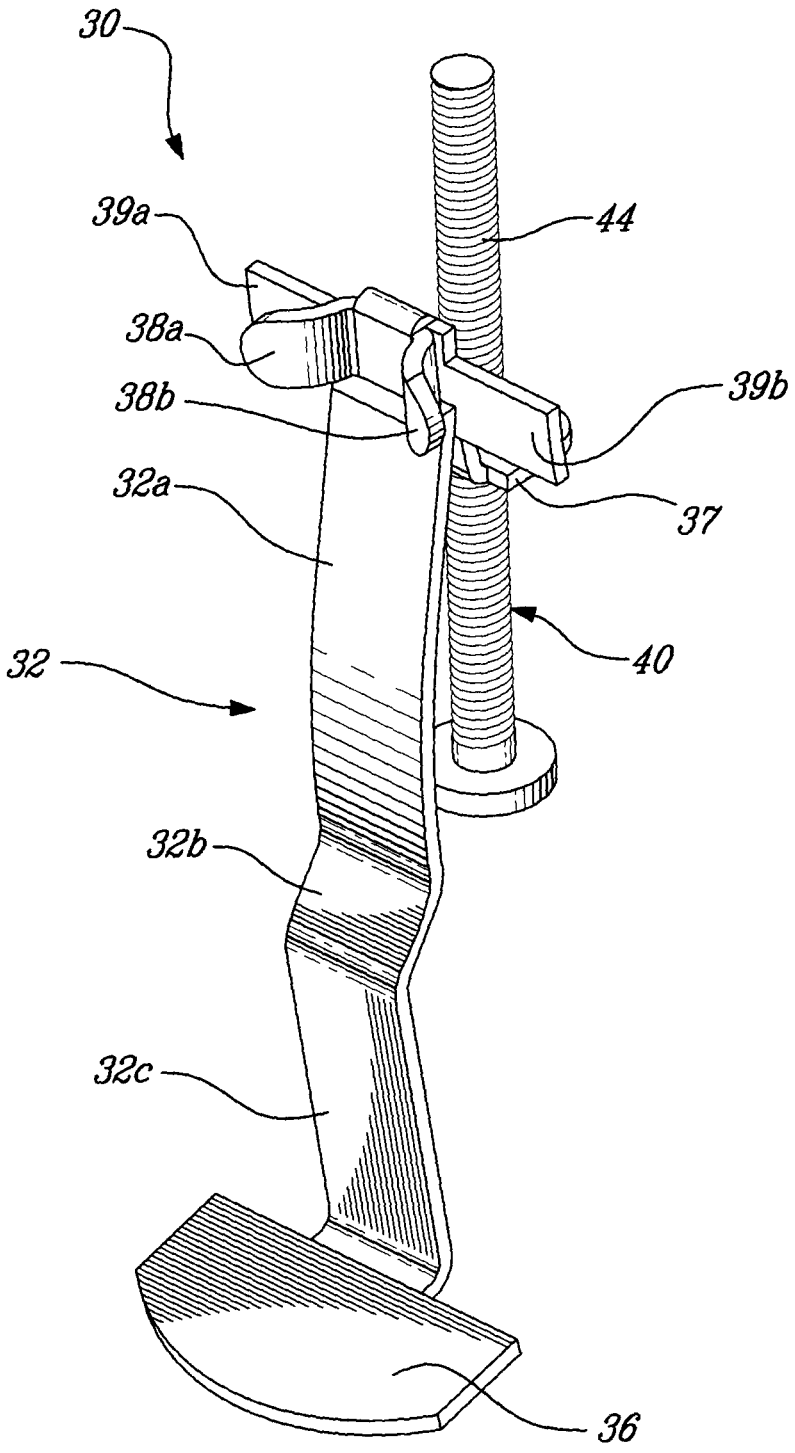
FIG. 2 is a perspective view of a hook of a light fixture according to an embodiment of the present invention.
Figure 3:
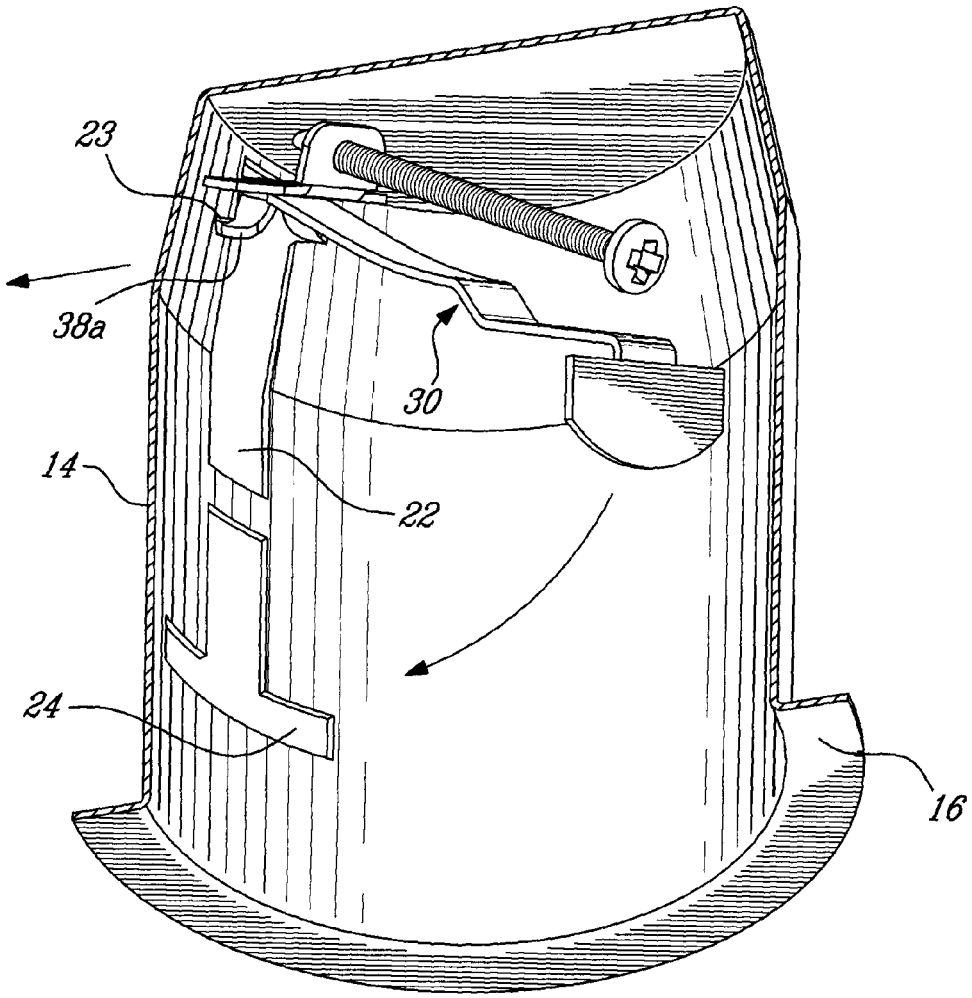
FIGS. 3 to 6 are cut of section of a light fixture according to an embodiment of the present invention, showing successive operations for securing a light fixture according to an embodiment of the present invention.

Referring to FIG. 2, a hook, generally denoted 30, comprises a main body 32. The main body 32 comprises an upper part 32*a*, an intermediate part 32*b* and a lower part 32*c*. The lower part 32*c* terminates, at the free end thereof, by a bent portion 36 extending at an angle relative to the main body 32, here shown substantially perpendicular to the main body 32. The intermediate part 32*b* connects the lower part 32*c* and the upper part 32*a*.

The hook 30 further comprises a support 31 for a bolt 40.

The upper part 32*a* secures the hook to the pot 10 while allowing the hook to be mobile along the first slot 24. Any kind of runner arrangement, such as a rail or groove or ring to guide the hook may be contemplated.

For example, the upper part 32*a* may terminate, at the free end thereof opposite the intermediate part 32*b*, with a pair of lateral outer extensions 38*a*, 38*b*, lateral inner extensions 39*a* and 39*b* and the support 31 with a threaded opening, the bolt 40 having a stem portion 44 which extends through the threaded opening in the support 31, as illustrated in FIGS. 2-6.

As shown in FIGS. 3 to 6, the hook 30 is inserted into the pot 10 from the inside of the pot 10 by inserting the lateral outer extensions 38*a*, 38*b* through the transverse channel 23 of the second slot 22 in the side wall 14 (FIG. 3), so that these lateral outer extensions 38*a*, 38*b* are positioned on the outer surface of the sidewall 14. The lateral inner extensions 39*a* and 39*b* are positioned inside the pot 10, the parts 32*c* and 32*a* of the hook 30 lying rearwardly of the sidewall 14 of the pot 10, and the bent portion 36 at the free end of the hook 30 is positioned outside the pot 10 through the enlarged section 26 of the first slot 24 (FIG. 4).

Thus the hook 30 is secured inside the pot 10 and the hook 30 can still move along the second slot 22, the bolt 40 being held by the support 31.

Figure 5:
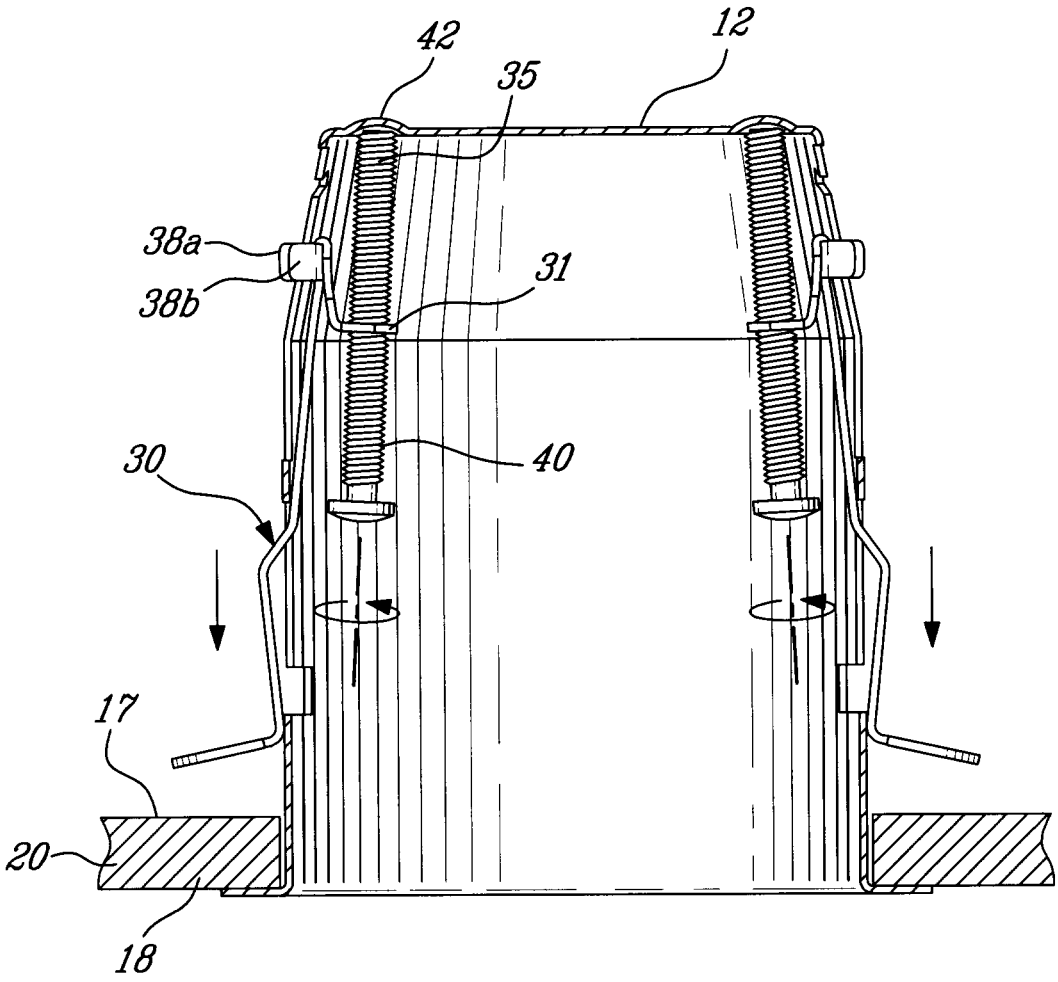
Figure 6:
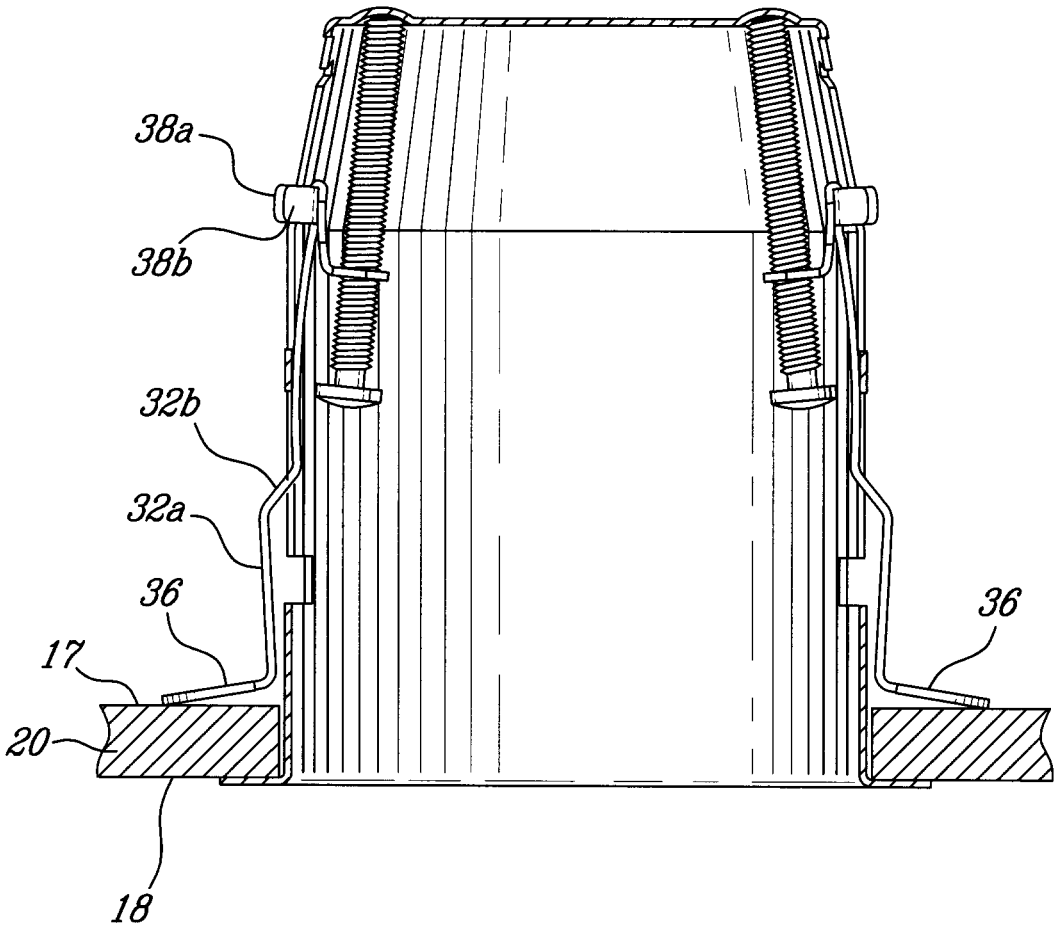

Upon rotating the bolt 40, the hook 30 slides down along the second slot 22, as shown in FIG. 5, until the lateral outer extensions 38*a*, 38*b* reach the bottom end of the slot 22 and the bent portion 36 at the free end of the body 32 comes in contact with the surface 17 opposite the surface 18 of the ceiling or wall 20 as shown in FIG. 6.

The end 35 of the bolt may be received in formations 42 of the bottom wall 12 of the pot 12, as shown.

Thus, to secure the pot 10 into the opening of the ceiling or wall 20 or other surface, once the pot 10 with the hook 30 is positioned inside the opening, the bolt 40 is rotated until the hook 30 reaches the position shown in FIG. 6 where the portion 36 of the hook 30 abuts the rear surface 16 of the ceiling or wall 20 or other surface, thus securing the pot in the opening of the ceiling or wall 20. As people in the art will appreciate, the hook 30 of the present invention, while mobile in the pot 10 along the slot 24, remains solidarily secured to the pot 10 during installation of the pot 10.

Although the present invention has been described hereinabove by way of embodiments thereof, it may be modified, without departing from the nature and teachings of the subject invention as described herein.

What is claimed is:

1. A light fixture for mounting into an opening defining a front surface and a rear surface, comprising:

a pot adapted to be received rearwardly of said front surface, said pot having a bottom wall and a sidewall; said sidewall defining a slot therein;

a hook comprising a body having a first end portion in mobile engagement with said sidewall of said pot along said slot; and a second end portion adapted to extend out of the pot through said slot; and a bolt having a stem supported inside the pot by said first end portion, whereby rotation of said bolt causes said first end portion to be guided down along said slot and said second end portion to move to bear against said rear surface to thereby secure said light fixture in said opening, wherein said slot comprises a upper slot and a lower slot aligned with respect to one another, said lower slot having a bottom section for said second end portion of the hook to extend out of the pot therethrough, and said upper slot guiding said first end portion of the hook.

2. A light fixture for mounting into an opening defining a front surface and a rear surface, comprising:

a pot adapted to be received rearwardly of said front surface, said pot having a bottom wall and a sidewall; said sidewall defining a slot therein;

a hook comprising a body having a first end portion in mobile engagement with said sidewall of said pot along said slot; and a second end portion adapted to extend out of the pot through said slot; and a bolt having a stem supported inside the pot by said first end portion, whereby rotation of said bolt causes said first end portion to be guided down along said slot and said second end portion to move to bear against said rear surface to thereby secure said light fixture in said opening, wherein said slot comprises a pair of vertically aligned slots to allow portions of said body of said hook to extend frontwardly and rearwardly of said side wall respectively.

3. The light fixture as defined in claim 2, wherein said body of said hook has a rectangular cross-section and a width slightly smaller than a width of said slots.

4. The light fixture as defined in claim 3, wherein said second end portion of said hook has an enlarged width relative to that of remaining portions of the hook and wherein one of said slots has an enlarged section, said second end portion of said hook extending out of the pot through said enlarged section of said slot.

5. The light fixture of claim 1, wherein said opening is provided in one of: i) a ceiling and ii) a wall.

6. The light fixture of in claim 1, wherein said sidewall comprises an outer peripheral flange adapted to bear against said front surface adjacent said opening.

7. The light fixture of claim 2, wherein said sidewall comprises an outer peripheral flange adapted to bear against said front surface adjacent said opening.

8. The light fixture of claim 2, wherein said opening is provided in one of: i) a ceiling and ii) a wall.

* * * * *